United States Patent [19]

Fitzgerald

[11] 3,945,707

[45] Mar. 23, 1976

[54] LAMP ASSEMBLY AND CONNECTOR FOR SAME

[75] Inventor: James J. Fitzgerald, Kinnelon, N.J.

[73] Assignee: Wagner Electric Corporation, Parsippany, N.J.

[22] Filed: Aug. 2, 1974

[21] Appl. No.: 493,875

[52] U.S. Cl. ..... 339/128; 339/125 L

[51] Int. Cl.[2] ..... H01R 13/48

[58] Field of Search ..... 339/17 D, 119 L, 125 L, 339/126 R, 128, 129, 61 L, 91 L, 154 L, 108 L, 156 L

[56] References Cited

UNITED STATES PATENTS

| | | | |
|---|---|---|---|
| 2,248,399 | 7/1941 | Watts | 339/128 |
| 2,741,747 | 4/1956 | Woofter | 339/128 |
| 3,285,548 | 11/1966 | Matto et al. | 339/128 X |

*Primary Examiner*—Roy Lake
*Assistant Examiner*—E. F. Desmond
*Attorney, Agent, or Firm*—Eyre, Mann & Lucas

[57] ABSTRACT

A lamp assembly including a connector enabling mounting of the lamp assembly in an aperture in a wall by insertion from either side without the use of tools. The connector defines a cavity for receiving the lamp, and is tapered in both directions from a transverse annular mounting groove. The connector is also split or slotted longitudinally to enable radial compression during insertion into an aperture. Lamp leads are mechanically and electrically connected to connecting pins or to insulated wires by being press-fitted in crimped splices which are interference-fitted into portions of the connector cavity.

10 Claims, 4 Drawing Figures

LAMP ASSEMBLY AND CONNECTOR FOR SAME

BACKGROUND OF THE INVENTION

1. Field of the Invention

The present invention relates to a connector or base for lamps, particularly subminiature lamps which are sometimes referred to as mini-wedge lamps.

2. Description of the Prior Art

The known type of lamp in which the base or connector is not permanently connected to the lamp has enabled the replacement of a burnt-out lamp without replacing the much more expensive base in which the lamp is mounted. However, this type of based lamp has been found to be deficient in making good electrical connections between the lamp leads and the base connectors. The observed intermittency of the connections of the very fine lamp leads to the base connectors makes this type of lamp unreliable. Such unreliability is unacceptable and even hazardous in certain applications, particularly those in which the lamp is intended to serve as a warning of a malfunction in some component or system of an automotive vehicle, for example. Furthermore, this type of prior-art based lamp is typically capable of being mounted only from one side of an apertured wall or panel board.

It is the purpose of the present invention to overcome the intermittency problem, and to provide a connector which enables the mounting of a lamp in an aperture in a wall or panel board by insertion from either side without the use of any tools. Thus, reliability is greatly increased, and both the fabrication of original equipment and replacement installation are facilitated.

SUMMARY OF THE INVENTION

The present invention is embodied in and carried out by a lamp connector defining a cavity for receiving a lamp therein, with the lamp leads being mechanically and electrically connected to connecting pins or lengths of heavier wire by being press-fitted with crimped splices which are then interference-fitted into portions of the connector cavity. The connector is tapered in both directions away from an annular mounting groove which is designed for engagement with the periphery of an aperture in a wall or panel board. The connector is split or slotted longitudinally to enable reduction in its diameter by the radial compression exerted by the aperture-defining circular edge of a wall or panel board upon either tapered section, depending upon whether the lamp assembly including the connector is inserted from the front or the rear. Preferably, a plurality of fins extend radially into the aforementioined cavity from the inner wall of the connector, and serve to retain the lamp in position by preventing lateral motion of the lamp.

BRIEF DESCRIPTION OF THE DRAWING

The present invention will be better understood if the written description thereof is read in connection with the accompanying drawing, of which.

DETAILED DESCRIPTION OF THE PREFERRED EMBODIMENT

Figure 1:
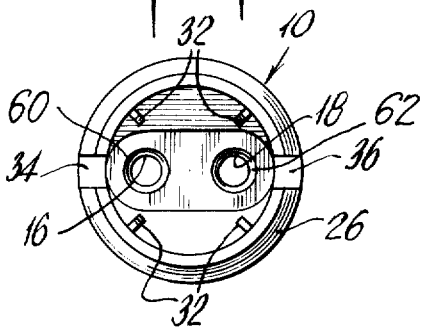
FIG. 1 is a top view of the connector embodying the present invention, looking into the cavity defined thereby.
Figure 2:
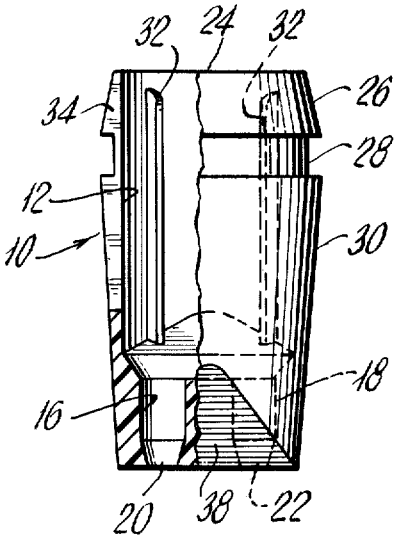
FIG. 2 is a side elevation of the connector shown in FIG. 1.
Figure 3:
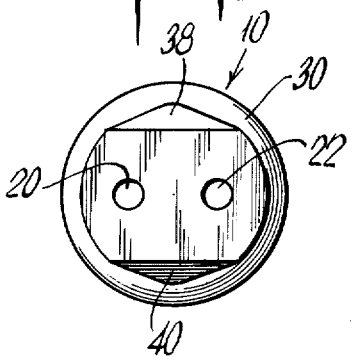
FIG. 3 is a bottom view of the connector shown in FIGS. 1 and 2.

Referring now to the drawing, the connector 10 defines a complex cavity having an upper cylindrical portion 12 and an intermediate tapered portion 14 which joins the cylindrical portion 12 with first and second tunnel portions 16 and 18 which extend to first and second small openings 20 and 22, respectively, in the bottom end of connector 10. The cylindrical cavity portion 12 extends from a large opening 24 at the upper end of connector 10 through the tapered collar portion 26, the annular mounting groove 28 formed in the outer peripheral wall transverse to the longitudinal axis of the connector 10, and into the tapered body portion 30. As shown, the collar portion 26 is tapered so as to have a progressively smaller cross-section as it extends from the annular mounting groove 28 to the large opening 24 in the upper end of the connector 10, while the body portion is tapered so as to have a progressively smaller cross-section as it extends from the annular mounting groove 28 to the small openings 20, 22 in the bottom end of the connector 10. The body portion 30 includes two textured surfaces 38 and 40 which are oppositely disposed and are sharply tapered from an intermediate region or locus of body portion 30 to the bottom end of connector 10. These surfaces 38, 40 form a finger grip, and eliminate molding problems by reducing concentration of plastic mass in the bottom or closed end of connector 10. A plurality of fins 32, preferably four in number and disposed at equal angles from one another, extend radially from the portion of the inner wall of connector 10 which defines the cylindrical cavity portion 12 to provide lateral support for the lamp to be mounted therein. By thus preventing the lamp from vibrating within the connector 10, flexing or bending of the lamp leads is prevented, thereby eliminating this phenomenon as a cause of lamp lead breakage.

The connector 10 includes slots 34 and 36 which extend through the collar portion 26, the annular mounting groove 28, and body portion 30 to intersect with the cavity defined by the connector 10. In the embodiment shown, these two slots 34, 36 are diametrically opposed from one another so as to enhance the ability of the connector 10 to reduce its maximum radial dimension when being inserted into an aperture in a printed circuit board or display panel. The combined features of (1) counter-tapering the collar portion 26 and the body portion 30 and (2) slotting the connector wall as just described make it possible to insert a lamp assembly such as that shown in FIG. 4 into a receiving aperture from either side of a printed circuit board or display panel in which the aperture is formed. The fins 32 are sufficiently flexible to be deflected when forced against the lamp envelope when the connector 10 is radially compressed.

Figure 4:
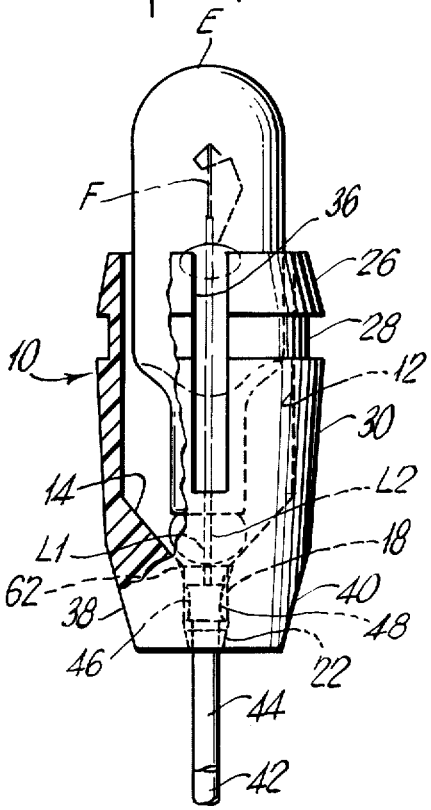
FIG. 4 is a side elevation of a connector of the type shown in FIGS. 1, 2 and 3, with the connector being rotated 90° about its longitudinal axis from the position of the connector shown in FIG. 2, and having a lamp mounted therein.

The lamp assembly shown in FIG. 4 illustrates the manner in which a typical lamp containing a supported filament F within an evacuated glass envelope E and having a pair of leads L1 and L2 extending from the glass envelope E of the filament F is mounted in the connector 10. The sealed bottom end of glass envelope E typically has a bulbous formation between the leads L1 and L2, and this bulbous formation is shown as being nested at the bottom end of tapered cavity portion 14 between the upper entrances to tunnel portions 16 and 18. The lamp leads L1 and L2 (hidden behind L1 in FIG. 4) are electrically and mechanically connected to connection devices 42 and 44 (hidden behind 42) such as rigid pins, or flexible multi-filament conductors which are preferably surrounded by insulating material except, of course, in the end region of connection to leads L1, L2. The aforementioned electrical and mechanical connection of lamp leads to the associated connection devices is effected by press-fit devices such as crimped splices 46 and 48 (hidden behind 46) which surround and press together overlapping ends of the associated lamp leads and connection devices. These steps of connecting the lamp lead wires to the connection devices by the use of crimped splices is carried out after the connection devices have been inserted through the tunnel portions 16 and 18 and out of the large opening 24. After these connections have been made, the connecting devices are drawn back into the connector cavity and particularly into their respective tunnel portions, the upper ends of which are chamferred 60, 62 to present a sharply-tapered, wide-mouthed opening to the associated crimped splices to facilitate drawing the crimped splices into the intermediate cylindrical portions of the associated tunnel portions 16, 18 of the cavity. The lower end of each tunnel portion 16, 18 is gradually tapered down to the small openings 20, 22 to enable the wedging or interference-fitting of the crimped splices 46, 48 therein and to prevent the crimped splices from being drawn through the small openings 20, 22. Thus, the lamp is mechanically secured in the connector.

The advantages of the present invention, as well as certain changes and modifications of the disclosed embodiment thereof, will be readily apparent to those skilled in the art. For example, the number, spacing and orientation of the slots 34, 36 may be changed in a variety of ways. For example, instead of being disposed parallel to the longitudinal axis of the connector, the slots may be disposed at an angle to that axis. Also, the number, spacing and orientation of the supporting fins 32 may be similarly changed, or the fins 32 may be eliminated altogether as shown in FIG. 4. A variety of alterations may be made in the configuration of the connector cavity and the various portions forming the cavity. For example, the tunnel portions 16, 18 may be continuously tapered from one end to the other, rather than being formed as shown with wide-mouth, sharply-tapered upper portions, cylindrical intermediate portions, and gradually-tapered narrow-mouth lower portions. It is the applicant's intention to cover all those changes and modifications which could be made to the embodiment of the invention herein chosen for the purposes of the disclosure without departing from the spirit and scope of the invention.

What is claimed is:

1. A connector defining a cavity for receiving a lamp to be mounted therein, and comprising an annular mounting groove formed in the outer periphery of said connector transverse to the longitudinal axis thereof; a collar portion extending longitudinally from said mounting groove to a large opening into said cavity in the first end of said connector; said collar portion being tapered down from said mounting groove to said large opening; a body portion extending longitudinally from said mounting groove in the direction opposite said collar portion toward first and second small openings into said cavity in the second end of said connector; said body portion being tapered down from said mounting groove to said second end of said connector; the diameter of said body portion adjacent the said mounting groove being of substantially the same diameter as the diameter of the collar portion adjacent the mounting groove; a plurality of slots extending longitudinally through at least a part of said collar portion, and at least a part of said body portion to permit deformation of said connector adjacent the mounting groove whereby the connector is insertable in a receiving aperture from either end of said connector.

2. The connector according to claim 1 wherein said body portion includes two textured surfaces which are more sharply tapered toward one another from an intermediate locus of said body portion to said second end of said connector than is the said taper from the said mounting groove to said second end of said connector.

3. The connector according to claim 1 wherein the cavity defined by said connector comprises a cylindrical portion extending from said large opening at said first end into said body portion, an intermediate tapered portion, and first and second tunnel portions extending to said first and second small openings, respectively, in said second end of said connector.

4. The connector according to claim 3 wherein each of said first and second tunnel portions comprises a tapered upper portion, a substantially cylindrical intermediate portion, and a tapered lower portion which defines the associated one of said first and second small openings, respectively, in said second end of said connector.

5. A connector defining a cavity for receiving a lamp to be mounted therein, and comprising an annular mounting groove formed in the outer periphery of said connector transverse to the longitudinal axis thereof; a collar portion extending longitudinally from said mounting groove to a large opening into said cavity in the first end of said connector; a body portion extending longitudinally from said mounting groove in the direction opposite said collar portion and tapered down toward first and second small openings into said cavity in the second end of said connector; a plurality of slots extending longitudinally through at least a part of said collar portion, and at least a part of said body portion to permit deformation of said connector adjacent the mounting groove; and wherein a plurality of equally-spaced fins extend radially into said cavity defined by said connector.

6. A connector defining a cavity for receiving a lamp to be mounted therein, and comprising an annular mounting groove formed in the outer periphery of said connector transverse to the longitudinal axis thereof; a collar portion extending longitudinally from said mounting groove to a large opening into said cavity in the first end of said connector; a body portion extending longitudinally from said mounting groove in the direction opposite said collar portion and tapered down toward first and second small openings into said cavity in the second end of said connector; a plurality of slots extending longitudinally through at least a part of said collar portion, and at least a part of said body portion to permit deformation of said connector adjacent the mounting groove; the cavity defined by said connector comprises a cylindrical portion extending from said large opening at said first end into said body portion, an intermediate tapered portion, and first and second tunnel portions extending to said first and second small openings, respectively, in said second end of said connector; a lamp comprising a glass envelope and first and second lamp leads extending from said glass envelope, first and second connection means mechanically and electrically connected to said first and second lamp leads and extending from said cavity defined by said connector through said first and second apertures in said second end thereof for connection to external circuitry, first and second press fit means operative to electrically and mechanically connect first and second lamp leads to said first and second connection means, respectively, said first and second press fit means being interference-fitted into said first and second tunnel portions, respectively.

7. The combination according to claim 6 wherein said lamp is supported in said cavity defined by said connector exclusively by said first and second lamp leads.

8. The combination according to claim 6 wherein said first and second connection means comprise first and second rigid connecting pins.

9. The combination according to claim 6 wherein said first and second connector means comprise first and second flexible conductors.

10. A lamp assembly comprising:

1. a lamp having an envelope and first and second lamp lead wires extending therefrom;
2. a connector comprising an annular mounting groove formed in the outer periphery of said connector transverse to the longitudinal axis thereof, a tapered collar portion extending longitudinally from said mounting groove, a body portion extending from said mounting groove in the direction opposite said collar portion, said connector defining a cavity for receiving at least a portion of said lamp envelope and said first and second lamp leads, said cavity comprising a cylindrical portion extending from a large opening in said collar portion of said connector and having equally-spaced fins extending radially therefom into said cavity, an intermediate tapered portion, and first and second tunnel portions extending from said tapered portion to first and second small openings in said body portion of said connector, and a plurality of slots intersecting with said cylindrical portion of said cavity and extending longitudinally through said collar portion, said mounting groove, and a predetermined portion of said body portion, and connecting with said cavity;

3. first and second connection means mechanically and electrically connected to said first and second lamp leads and extending from said first and second tunnel portions through said first and second small openings to enable electrical connection of said lamp to external circuitry; and
4. first and second press fit means operative to mechanically and electrically connect said first and second lamp leads to said first and second connection means, respectively, said first and second press fit means being interference-fitted into said first and second tunnel portions of said cavity, respectively.

* * * * *